US011822275B2

(12) United States Patent
Shao

(10) Patent No.: US 11,822,275 B2
(45) Date of Patent: Nov. 21, 2023

(54) IMAGE FORMING METHOD, IMAGE FORMING APPARATUS, AND STORAGE MEDIUM FOR CONCENTRATION CORRECTION

(71) Applicant: Zhuhai Pantum Electronics Co., Ltd., Zhuhai (CN)

(72) Inventor: Zhe Shao, Zhuhai (CN)

(73) Assignee: Zhuhai Pantum Electronics Co., Ltd., Zhuhai (CN)

( * ) Notice: Subject to any disclaimer, the term of this patent is extended or adjusted under 35 U.S.C. 154(b) by 0 days.

(21) Appl. No.: 17/505,928

(22) Filed: Oct. 20, 2021

(65) Prior Publication Data

US 2022/0128921 A1 Apr. 28, 2022

(30) Foreign Application Priority Data

Oct. 27, 2020 (CN) ..... 202011161377.7

(51) Int. Cl.
*G03G 15/00* (2006.01)
*G03G 15/01* (2006.01)
*G03G 15/02* (2006.01)

(52) U.S. Cl.
CPC ..... *G03G 15/5058* (2013.01); *G03G 15/0178* (2013.01); *G03G 15/0266* (2013.01); *G03G 15/5041* (2013.01); *G03G 2215/00569* (2013.01)

(58) Field of Classification Search
CPC ..... G03G 15/0266; G03G 15/00569; G03G 15/5058; G03G 15/5041
See application file for complete search history.

(56) References Cited

U.S. PATENT DOCUMENTS

2008/0253793 A1 10/2008 Ishibashi et al.
2013/0330095 A1 12/2013 Son et al.
2013/0342853 A1* 12/2013 Nakashio ..... G03G 15/5041 358/1.1
2014/0294412 A1 10/2014 Tanaka et al.
2017/0097593 A1* 4/2017 Itagaki ..... G03G 15/1675
2017/0343916 A1* 11/2017 Tanaka ..... G03G 15/04
2021/0064946 A1* 3/2021 Lee ..... G06K 15/027

FOREIGN PATENT DOCUMENTS

CN 101539746 A 9/2009
CN 103389636 A 11/2013
CN 108475030 A 8/2018

* cited by examiner

*Primary Examiner* — Arlene Heredia
(74) *Attorney, Agent, or Firm* — Anova Law Group, PLLC

(57) ABSTRACT

An image forming method, an image forming apparatus, and a storage medium are provided in embodiments of the present disclosure. The method includes rotating an image carrier along a preset direction, where the image carrier at least includes a first region and a second region; and simultaneously applying voltages to a first image forming module and a second image forming module, such that the first image forming module forms a first image on the first region of the image carrier based on the voltages, and the second image forming module forms a second image on the second region of the image carrier based on the voltages. Each of the first image and the second image includes a plurality of patterns with different concentrations; and a quantity of patterns in the first image and the second image is determined based on a first preset distance.

7 Claims, 6 Drawing Sheets

IMAGE FORMING METHOD, IMAGE FORMING APPARATUS, AND STORAGE MEDIUM FOR CONCENTRATION CORRECTION

CROSS-REFERENCE TO RELATED APPLICATION

This application claims priority to Chinese Patent Application No. 202011161377.7, filed on Oct. 27, 2020, the entire content of which is incorporated herein by reference.

TECHNICAL FIELD

The present disclosure generally relates to the field of image forming technology and, more particularly, relates to an image forming method, an image forming apparatus, and a storage medium.

BACKGROUND

Image forming apparatuses, such as printers, copiers and the like, are used to form images on image forming media and play a critical role in applications, where the performance of the image forming apparatuses determines image quality. For example, color printers are used to form color images on image forming media. In order to improve the quality of color images, the color printer often needs to perform color concentration correction. In the concentration correction process, the color printer controls four color (KMCY) toner cartridges to form four color images on an image carrier by adjusting different voltage levels. The image includes a plurality of patterns with different concentrations, the patterns with different concentrations correspond to different voltage levels, and the concentration data of the patterns are used to complete concentration correction.

In the existing image forming technology for concentration correction, four color toner cartridges respectively form 6 patterns with different concentration levels on the image carrier (in other existing technology, 8 or even more than 10 patterns with different concentration levels can also be formed). In low-cost color printers, in order to reduce costs, the four color toner cartridges may use a same high-voltage power supply and may be limited by the positions of the four color toner cartridges. The four color toner cartridges may respectively form four first toner images on corresponding positions of the image carrier, the first toner images may include four patterns with different concentration levels, and the four first toner images may correspond to the first page, that is, the four first toner images may be formed on a same page of the image forming medium. Next, the four toner cartridges may form four second toner images on the image carrier, the second toner images may include two patterns with different concentration levels, and the four second toner images may correspond to the second page, that is, the four second toner images may be formed on a same page of the image forming medium. However, the first toner images and the second toner images cannot be formed on the same page of the image forming medium. For example, taking K color as an example, the K color toner cartridge may respectively form patterns corresponding to 4 different concentration levels of the first toner image of the first page and patterns corresponding to 2 different concentration levels of the second toner image of the second page.

In the existing technology, a certain time interval may be between after the toner cartridge forms the first toner image and before the toner cartridge forms the second toner image on the image carrier. As a result, the number of frictions between the residual toner in the toner cartridge and a toner feed roller may increase, thereby increasing the charge amount on a developing roller. Therefore, the color of the first pattern of the second toner image formed by the toner cartridge on the image carrier may become lighter, which may cause flare phenomenon easily. Moreover, if the toner content in the toner cartridge is insufficient, the number of rotations of the toner feed roller may increase due to the time interval, such that the residual toner may be replenished on the developing roller, and the concentration of the pattern of the second toner image formed on the image carrier may not be significantly reduced. As a result, it may be mistakenly believed that the toner content is sufficient during the subsequent detection of the toner content of the second toner image, which may cause the toner shortage problem in subsequent use, and also cause unnecessary waste of the residual toner in the toner cartridge.

In the existing technology, since four first toner images correspond to the same page, the spacing between adjacent patterns may be small (taking a K color image as an example, four K color patterns may occupy 65 mm (i.e., the sum of 4×16 mm and additional 1 mm), and the sum of the height of the pattern and the spacing between adjacent patterns may be 16 mm). In other words, four images may be arranged evenly and sequentially on one page length, and each image may include four patterns arranged evenly and sequentially, that is, 16 patterns may be arranged sequentially on one page length. The height of the pattern corresponds to the signal value of the concentration of the pattern detected by a sensor, and the spacing between adjacent patterns corresponds to the allowable switching time between adjacent voltage levels. Therefore, due to the small pattern height, the signal value error of the concentration of the pattern detected by the sensor may increase. The spacing between adjacent patterns may be small, such that the allowable switching time between adjacent voltage levels may be relatively short, correspondingly. As a result, the control difficulty of switching between adjacent voltage levels may increase with large error, phenomena such as voltage switching premature, lagging or the like may be easily occurred, and errors may be generated in the pattern concentration data, which eventually causes inaccurate or abnormal concentration correction results.

SUMMARY

One aspect of the present disclosure provides an image forming method, applied to an image forming apparatus, where the image forming apparatus includes a first image forming module and a second image forming module having a first preset distance there-between; the first image forming module is configured to form a first image on an image carrier, and the second image forming module is configured to form a second image on the image carrier. The method includes rotating the image carrier along a preset direction, where the image carrier at least includes a first region and a second region; and simultaneously applying voltages to the first image forming module and the second image forming module, such that the first image forming module forms the first image on the first region of the image carrier based on the voltages, and the second image forming module forms the second image on the second region of the image carrier based on the voltages. Each of the first image and the second image includes a plurality of patterns with different concentrations; a quantity of patterns in the first image and the second image is determined based on the first preset distance; a concentration of a pattern of the plurality of patterns corresponds to a magnitude of a voltage; and an allowable switching time between two adjacent voltages corresponding to two adjacent patterns is determined by a spacing between the two adjacent patterns.

Another aspect of the present disclosure provides an image forming apparatus. The image forming apparatus includes an image carrier, rotating along a preset direction, where the image carrier at least includes a first region and a second region each having a preset length; a first image forming module, configured to form a first image on the image carrier; a second image forming module, configured to form a second image on the image carrier, where a first preset distance is between the first image forming module and the second image forming module; and a voltage applying unit, configured to simultaneously apply voltages to the first image forming module and the second image forming module. The first image forming module forms the first image on the first region of the image carrier based on the voltages; the second image forming module forms the second image on the second region of the image carrier based on the voltages; each of the first image and the second image includes a plurality of patterns with different concentrations; a quantity of patterns in the first image and the second image is determined based on the first preset distance; a concentration of a pattern of the plurality of patterns corresponds to a magnitude of a voltage; and an allowable switching time between two adjacent voltages corresponding to two adjacent patterns is determined by a spacing between the two adjacent patterns.

Another aspect of the present disclosure provides a non-transitory computer-readable storage medium, containing program instructions for, when being executed by a processor, performing an image forming method. The method includes rotating the image carrier along a preset direction, where the image carrier at least includes a first region and a second region; and simultaneously applying voltages to the first image forming module and the second image forming module, such that the first image forming module forms the first image on the first region of the image carrier based on the voltages, and the second image forming module forms the second image on the second region of the image carrier based on the voltages. Each of the first image and the second image includes a plurality of patterns with different concentrations; a quantity of patterns in the first image and the second image is determined based on the first preset distance; a concentration of a pattern of the plurality of patterns corresponds to a magnitude of a voltage; and an allowable switching time between two adjacent voltages corresponding to two adjacent patterns is determined by a spacing between the two adjacent patterns.

Another aspect of the present disclosure provides a computer program product. The computer program product includes program instructions for, when being executed by a processor, performing an image forming method.

Other aspects of the present disclosure can be understood by those skilled in the art in light of the description, the claims, and the drawings of the present disclosure.

The present disclosure provides the image forming method and the image forming apparatus to reduce the switching control difficulty between adjacent voltages, which is beneficial for improving the stability and reliability of concentration correction and avoiding unnecessary waste of residual toner.

DETAILED DESCRIPTION

The terms used in the implementation manners of the present disclosure are only used to explain specific embodiments of the present disclosure and are not intended to limit the present disclosure.

Figure 1A:
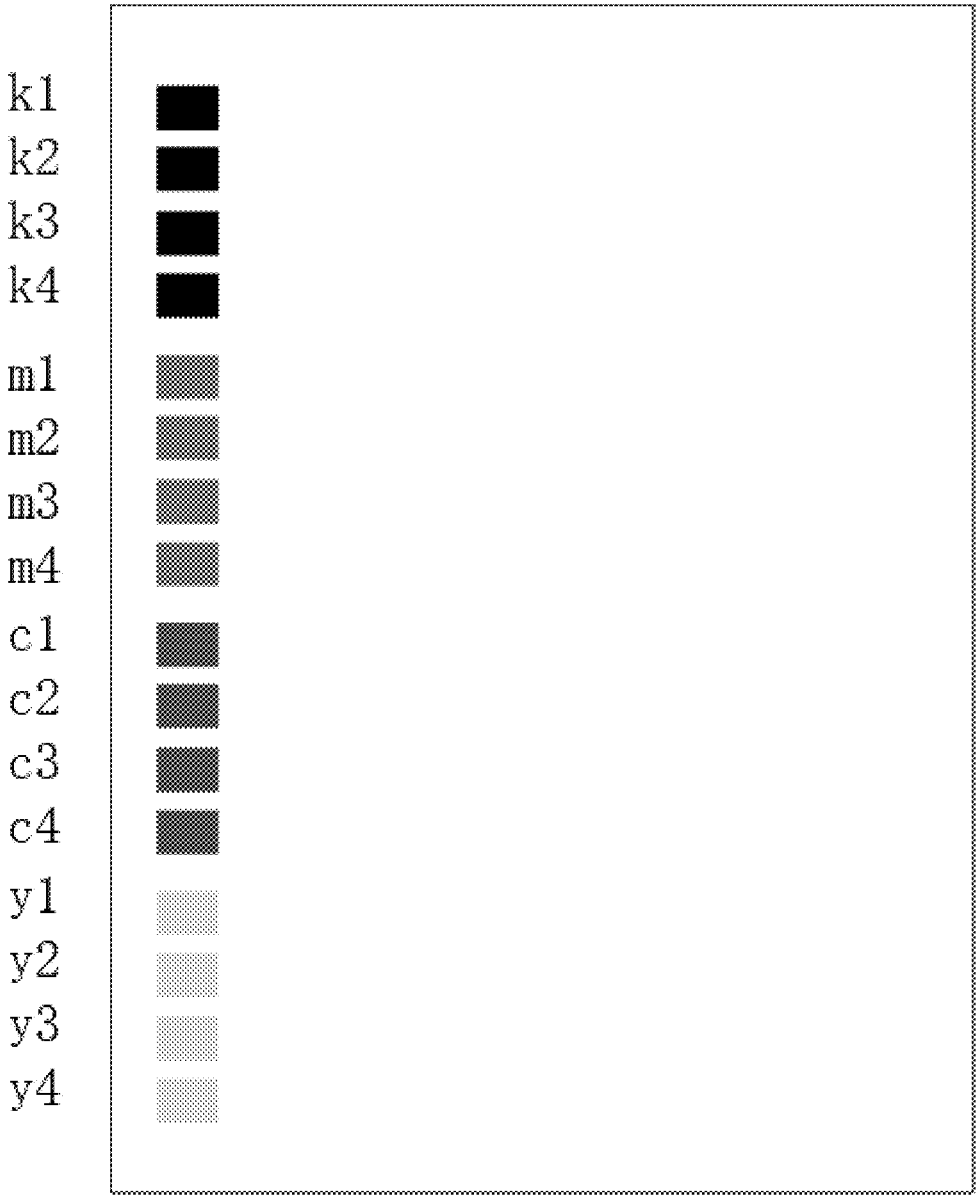
FIG. 1A illustrates a schematic of KMCY images respectively formed on a corresponding first page by an existing image forming apparatus.
Figure 1B:
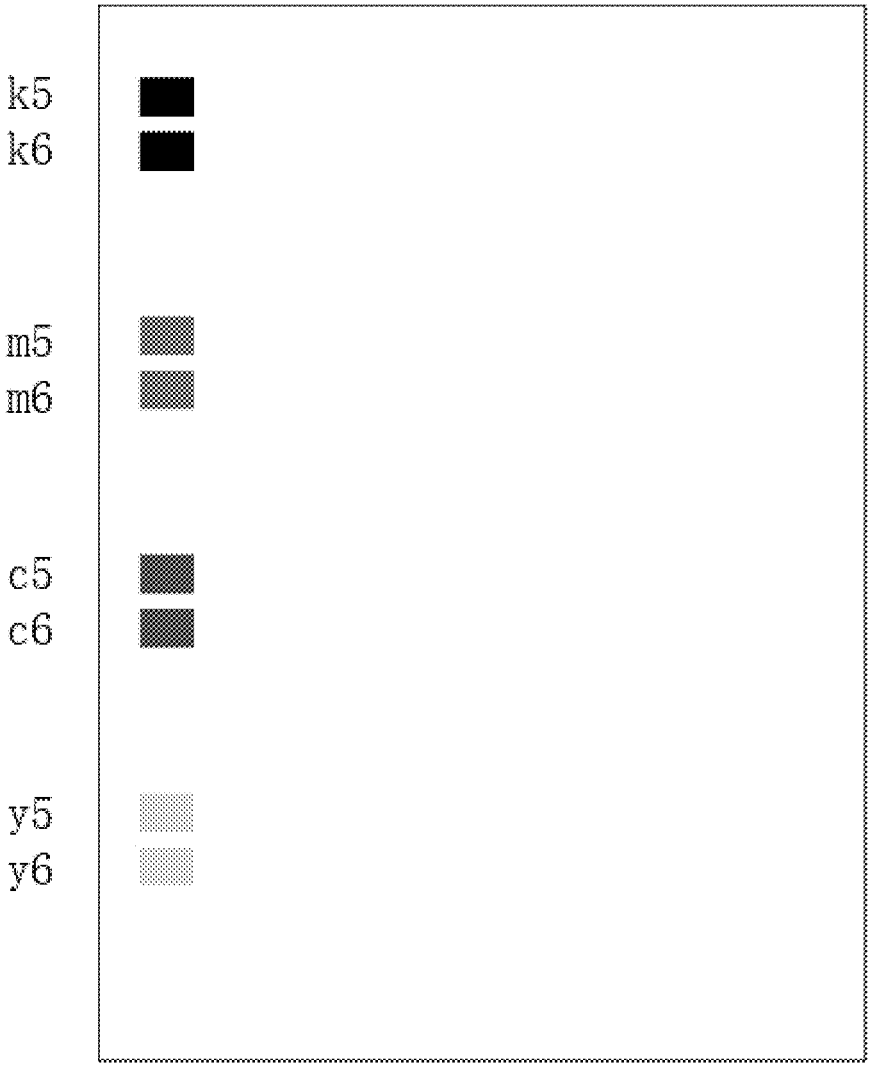
FIG. 1B illustrates a schematic of KMCY images respectively formed on a corresponding second page by an existing image forming apparatus.

In the existing implementation manners, as shown in FIG. 1A and FIG. 1B, the existing image forming apparatus may control four color toner cartridges to form first toner images of four colors (e.g., KMCY colors) on the first page, and each of the first toner images may include four patterns of different concentrations (e.g., the K color image includes k1-k4 patterns, the M color image includes m1-m4 patterns, the C color image includes c1-c4 patterns, and the Y color image includes y1-y4 patterns); and the existing image forming apparatus may control four color toner cartridges to form second toner images of four colors on the second page, and each of the second toner images may include two patterns with different concentrations (e.g., the K color image includes k5-k6 patterns, the M color image includes m5-m6 pattern, the C color image includes c5-c6 pattern, and the Y color image includes y5-y6 patterns). Since the four first toner images correspond to a same page, the spacing between adjacent patterns may be small (taking the K color image as an example, the four patterns of K color may occupy 65 mm, and the sum of the height of the pattern and the spacing between the adjacent patterns may be 16 mm). In other words, the four images may be arranged evenly and sequentially on one page length, and each of the images may include four patterns arranged evenly and sequentially, that is, 16 patterns may be arranged sequentially on one page length. The height of the pattern corresponds to the signal value of the concentration of the pattern detected by a sensor, and the spacing between adjacent patterns corresponds to the allowable switching time between adjacent voltage levels. Therefore, due to the small pattern height, the signal value error of the concentration of the pattern detected by the sensor may increase. The spacing between adjacent patterns may be small, such that the allowable switching time between adjacent voltage levels may be relatively short, correspondingly. As a result, the control difficulty of switching between adjacent voltage levels may increase with large error, phenomena such as voltage switching premature, lagging or the like may be easily occurred, and errors may be generated in the pattern concentration data, which eventually causes inaccurate or abnormal concentration correction results. Furthermore, since the toner cartridge of a same color form separate patterns on different pages, the problem of unnecessary waste of residual toner may be likely to occur.

To solve the above-mentioned problems, the present disclosure provides an image forming method and an image forming apparatus to reduce the switching control difficulty between adjacent voltages, which is beneficial for improving the stability and reliability of concentration correction and avoiding unnecessary waste of residual toner.

The present disclosure provides the image forming method, applied to the image forming apparatus. The method may include the following steps.

An image carrier may be rotated along a preset direction, where the image carrier may at least include a first region and a second region.

The image forming apparatuses may include equipment, including a color printer, a multifunction machine and the like, for forming images such as text or pictures on image forming media. The image forming media may include materials such as paper, cloth, leather, film, and the like. In one embodiment, the image forming apparatus may include the image carrier and a plurality of image forming modules; and the image forming modules may be configured to form images of corresponding colors on the image carrier. The image forming module may include a photosensitive drum, a toner cartridge, and the like. In one embodiment, the image forming apparatus may include 4 image forming modules arranged sequentially. Each of the image forming modules may store toner of one color, such as black (K color), magenta (M color), cyan (C color), or yellow (Y color), such that image forming apparatus may respectively form images of corresponding colors. During an operating process, the four image forming modules may sequentially generate a black image, a magenta image, a cyan image, and a yellow image which are combined to generate a color image.

A representative example of the image forming apparatus may include a printer which prints an image received through communication on an image forming medium. However, the image forming apparatus may not be limited to a printer and may be a multifunction machine capable of performing various functions of printing, copying, scanning, and facsimile described above.

In one embodiment, the image forming apparatus may include a first image forming module, a third image forming module, a second image forming module, and a fourth image forming module which are arranged sequentially, and further include the image carrier. For example, the image forming apparatus may include four toner cartridges (i.e., the first toner cartridge, the third toner cartridge, the second toner cartridge, and the fourth toner cartridge which are sequentially arranged), and further include the image carrier. A first preset distance may be between the first image forming module and the second image forming module, and a second preset distance may be between the third image forming module and the fourth image forming module. For example, the axle center of the K color photosensitive drum of the first image forming module and the axle center of the C color photosensitive drum of the second image forming module may be projected on a plane perpendicular to two axle centers of above photosensitive drums; and the first preset distance may be the length of the connecting line between projections of two axle centers. For another example, the first preset distance may be a spacing between the K color toner cartridge and the C color toner cartridge; and the second preset distance may be a spacing between the M color toner cartridge and the Y color toner cartridge. It should be understood that the first preset distance and the second preset distance may be determined according to the spatial structure of the image forming apparatus, and the arrangement positions of the first image forming module, the third image forming module, the second image forming module, and the fourth image forming module. In the process of forming an image on the image forming medium by the image forming apparatus, the image forming module may be configured to generate an image (e.g., a toner image) on the image carrier; and the image may include an image formed by toner. Therefore, the image carrier may transfer the image and form a color image on the image forming medium, such as forming a color image on printing paper. Obviously, the image forming apparatus may also include more image forming modules, and the image forming modules may also be configured to generate images of other colors, which may not be limited according to various embodiments of the present disclosure.

The image forming medium may include multiple pages, such as the first page, the second page, the third page, the fourth page, and the like; and the page may have a certain size. Taking A4 printing paper as an example, the size of the page may be 210 mm×297 mm. The image carrier may include a region corresponding to the page. During an operating process, each of the image forming module may generate different color images in the region of the image carrier, and the image carrier may transfer and form a color image on a corresponding page.

In one embodiment, the image carrier may be a transfer belt, a photosensitive drum, or the like. The image carrier may include the first region, the second region, the third region, and the fourth region. The image forming apparatus may rotate the image carrier in a preset direction (e.g., counterclockwise rotation, clockwise rotation, or the like), such that the image forming apparatus may form images at different regions of the image carrier. Since the image carrier is a rotatable circular belt, different regions may correspond to a same position of the rotating belt in different rotation periods, or different regions may correspond to different positions of the rotating belt during a same rotation period.

For example, the image forming apparatus may further include an image acquirer, a controller, and an image processor. The image acquirer may be configured to acquire an image formed on the surface of the image carrier or the image forming medium. The image processor may output corresponding image data to the controller based on the image, such that the controller may control the image forming module to form a corresponding image on the image carrier based on the image data, and the image carrier may transfer the image and form a corresponding image on the image forming medium.

It should be noted that the image forming apparatus may perform image concentration correction; for example, the image forming apparatus may perform hue recursive control. For example, when external power is supplied to the image forming apparatus after external power supply is turned off or when the image forming module (e.g., a photosensitive drum or a toner cartridge) is replaced, the image forming apparatus may perform image concentration correction.

During concentration correction, the controller of the image forming apparatus may acquire a test pattern for concentration correction and generate a corresponding image generation signal, and transmit the signal to the image forming module, such that the image forming module may form a corresponding image on the image carrier. The image may include patterns of different concentrations, the concentration of each pattern of the image may be detected by a concentration sensor, and the signal may be outputted to the controller, thereby completing concentration correction.

It should be understood that the test pattern may be stored in an internal storage module of the image forming apparatus, or the test pattern may be stored in an external device, and the external device may be connected (e.g., a wireless connection or a wired connection) to the image forming apparatus, such that the image forming apparatus may obtain the test pattern from the external device; or the test pattern may be stored in the cloud, and the image forming apparatus may obtain the test pattern from the cloud.

In one embodiment, the shape and size of the test pattern may correspond to the shape and size of the pattern. In order to facilitate the detection of the concentration sensor, the shape and size of the test pattern should be reasonable. For example, the shape of the test pattern may be a square, a bar, a circle, or a regular pattern, or the like, such that the shape of the pattern may also be a square, a bar, a circle, or a regular pattern, or the like. The height and width of the test pattern may be preset, such that the height and width of the pattern may be preset. In order to improve the detection signal stability of the concentration sensor, the height of the pattern should be greater than a preset length. The height of the pattern may be along the length direction of one page, and the length direction may correspond to the rotation direction of the image carrier.

Voltages may be simultaneously inputted to the first image forming module and the second image forming module, such that the first image forming module may form a first image on the first region of the image carrier based on the voltages, and the second image forming module may form a second image on the second region of the image carrier based on the voltages. The first image and the second image may respectively include a plurality of patterns with different concentrations, and the quantity of patterns in the first image and the second image may be determined based on the first preset distance. The voltages may be divided into a plurality of levels with different voltage levels, and the concentrations of the patterns may correspond to magnitudes of different voltage levels. The allowable switching time between two adjacent voltages may be determined by the spacing between two adjacent patterns corresponding to the adjacent voltages.

It should be noted that, based on the first preset distance, the preset lengths of the first region and the second region may be determined. For example, the preset length of the first region may be greater than the first preset distance between the first image forming module and the second image forming module. It should be understood that the first image forming module and the second image forming module may be located on two sides of the third image forming module, such that the first preset distance may be greater than the sum of the distance between the first image forming module and the third image forming module and the distance between the third image forming module and the second image forming module.

For example, the preset lengths of the first region and the second region may respectively correspond to the length of one page; that is, the first image on the first region may be printed and formed on the first page, and the second image on the second region may be printed and formed on the second page. Or, the preset lengths of the first region and the second region may respectively correspond to one half length of one page; that is, the first image on the first region may be printed and formed on one half of one page, and the second image on the second region may be printed and formed on another half of one page. Optionally, the first image on the first region and the second image on the second region may be printed on the upper half and the lower half of a same page. It should be understood that the preset length may also correspond to another proportional length of one page, which may not be limited according to various embodiments of the present disclosure.

It should be noted that the preset length may correspond to one half length of one page, and the first image may include at most 6 patterns. Therefore, compared with the existing image forming apparatus that forms 16 patterns on one page, 4 patterns of a same color may occupy 65 mm of the length of one page, such that the sum of the height of the pattern and the spacing between adjacent patterns may be 16 mm (e.g., (65−1)/4). However, in one embodiment, at most 6 patterns of the same color may occupy one half of the length (130 mm) of one page, such that the sum of the height of the pattern of the first image and the spacing between adjacent patterns may not be greater than 22 mm, and the spacing between adjacent patterns and/or the height of the pattern may be increased. The spacing between adjacent patterns may include the spacing between the bottom of a previous pattern and the top of a next pattern, and the spacing between adjacent patterns may correspond to the time interval between adjacent patterns (i.e., the time interval between the formation of the previous pattern and the formation of the next pattern). In other words, the height of the pattern may be determined based on the first preset distance and the quantity of patterns.

When the height of the pattern increases, the concentration signal value of the pattern detected by the concentration sensor may be more stable, which is beneficial for improving detection stability. Since the allowable switching time between adjacent voltages corresponds to the spacing between adjacent patterns, that is, in the present disclosure, the allowable switching time between adjacent voltages may be relatively long, the switching control difficulty between adjacent voltages may be reduced, and the stability and reliability of concentration correction may be improved.

For example, the height, size, or shape of the pattern may be designed in advance, the spacing between adjacent patterns may be determined by the height, size, or shape of the pattern and the like; then, the allowable switching time between adjacent voltages corresponding to adjacent patterns may be determined by the spacing, the spacing between adjacent patterns may correspond to the time interval for forming two adjacent patterns, and the time interval between two adjacent patterns may be consistent with the allowable switching time between corresponding adjacent voltages.

In one embodiment, the first image forming module can be connected to a power source, and the power source can provide different voltage magnitudes to the first image forming module, such that the first image forming module may form patterns of corresponding concentrations on the image carrier. The voltages may have a relationship with the concentrations of the patterns in a one-to-one correspondence. The concentrations of the different patterns may be same or different; correspondingly, the voltages may be same or different, which may not be limited according to various embodiments of the present disclosure.

In an optional implementation manner, the first image may include at least 6 patterns sequentially arranged on the first region. For example, the first region may include a first position, a second position, a third position, a fourth position, a fifth position, and a sixth position arranged sequentially; the first image may include a first pattern, a second pattern, a second pattern, a third pattern, a fourth pattern, a fifth pattern, and a sixth pattern; the voltages may include a first voltage, a second voltage, a third voltage, a fourth voltage, a fifth voltage, and a sixth voltage.

Forming, by the first image forming module, the first image on the first region of the image carrier based on the voltages may include, by the first image forming module, forming the first pattern at the first position based on the first voltage, forming the second pattern at the second position based on the second voltage, forming the third pattern at the third position based on the third voltage, forming the fourth pattern at the fourth position based on the fourth voltage, forming the fifth pattern at the fifth position based on the fifth voltage, and forming the sixth pattern at the sixth position based on the sixth voltage.

The image carrier may keep rotating, and after the first image forming module forms the first pattern at the first position of the image carrier, the first voltage may be switched to the second voltage; then the first image forming module may form the second pattern at the second position of the image carrier, and the second voltage may be switched to the third voltage; then the first image forming module may form the third pattern at the third position, and the third voltage may be switched to the fourth voltage; then the first image forming module may form the fourth pattern at the fourth position, and the fourth voltage may be switched to the fifth voltage; then the first image forming module may form the fifth pattern at the fifth position, and the fifth voltage may be switched to the sixth voltage; and then the first image forming module may form the sixth pattern at the sixth position.

Compared with the existing image forming apparatus, in the method of one embodiment, the spacing between adjacent patterns may be relatively large, and the allowable switching time between adjacent voltages may be relatively large, such that the switching control difficulty of between the first voltage and the second voltage in the method may be relatively low.

It should be understood that the first image may also include the third pattern, the fourth pattern, the fifth pattern, and the sixth pattern; and the first pattern, the second pattern, the third pattern, the fourth pattern, the fifth pattern, and the sixth pattern may be arranged evenly and sequentially on the first region. That is, the heights of the first pattern, the second pattern, the third pattern, the fourth pattern, the fifth pattern, and the sixth pattern may be same, and the spacing between adjacent patterns may be same.

In the above-mentioned method, after the pattern of a previous concentration is formed, the voltage may be switched within the switching time, and then the pattern of a next concentration may be formed, such that the image forming module may sequentially form a plurality of the patterns evenly arranged on the image carrier.

In an optional implementation manner, the image forming apparatus may further include the third image forming module and the fourth image forming module with the second preset distance. The first image forming module, the third image forming module, the second image forming module and the fourth image forming module may be arranged sequentially; and the image carrier may further include the third region and the fourth region.

The method may further include that the voltages may be inputted into the third image forming module and the fourth image forming module simultaneously, such that the third image forming module may form a third image on the third region of the image carrier based on the voltages, and the fourth image forming module may form a fourth image on the fourth region of the image carrier based on the voltages. The third image and the fourth image may respectively include a plurality of patterns of different concentrations, and the quantity of patterns in the third image and the fourth image may be determined based on the second preset distance.

In one embodiment, the control manners of the second image forming module, the third image forming module, and the fourth image forming module may be similar to the control manner of the first image forming module, which may not be described in detail herein. For example, the second image may include at most 6 patterns arranged evenly and sequentially on the second region, such that the sum of the height of the pattern of the second image and the spacing between adjacent patterns may not be greater than 22 mm, and the spacing between adjacent patterns and/or the height of the patterns may increase. The third image may include at most 6 patterns arranged evenly and sequentially along the length of the third region, such that the sum of the height of the pattern of the third image and the spacing between adjacent patterns may not be greater than 22 mm, and the spacing between adjacent patterns and/or the height of the patterns may increase. The fourth image may include at most 6 patterns arranged evenly and sequentially on the fourth region, such that the sum of the height of the pattern of the fourth image and the spacing between adjacent patterns may not be greater than 22 mm, and the spacing between adjacent patterns and/or the height of the patterns may increase.

It should be noted that the quantity of patterns of the first image, the second image, the third image, and the fourth image may be greater than or equal to 6 and less than or equal to 12. That is, the image may include at most 12 patterns arranged evenly and sequentially along the length of a corresponding region, and the sum of the height of the pattern and the spacing between adjacent patterns may be greater than or equal to 22 mm. For example, corresponding to the length of one page, the first image may form patterns of 10 different concentrations on the first region, such that the sum of the height of the pattern and the spacing between adjacent patterns may be 260/10 mm=26 mm.

It can be seen that the first image, the second image, the third image, and the fourth image may respectively correspond to different pages. In addition, corresponding to a same page, there may be only a plurality of patterns of a same color and different concentrations, and the quantity of the patterns may be greater than or equal to 6 and less than or equal to 12, thereby being beneficial for completing concentration correction. In other words, the same image forming module does not need to form images of the same color on multiple pages, such that the problem of flare phenomenon may be avoided when the image forming module forms an image of the same color on the second page again. Moreover, before the image forming module forms a corresponding image, the image forming device may detect the toner content in the image forming module in advance; and, if the toner content in the image forming module is insufficient, the image forming module may terminate the concentration correction in advance, avoiding unnecessary waste of residual toner.

Figure 2:
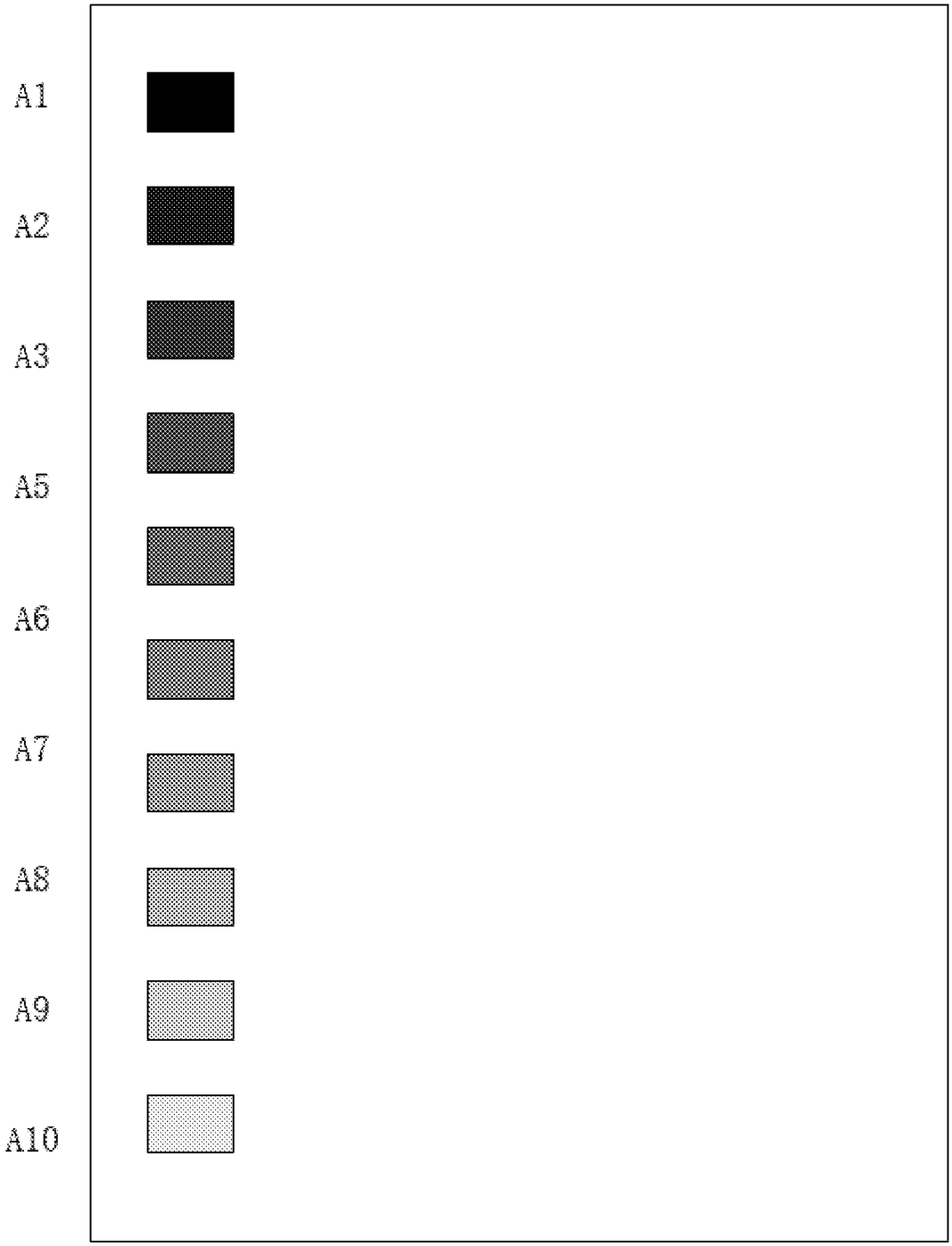
FIG. 2 illustrates a schematic of a color image formed on a corresponding page by an image forming method according to various embodiments of the present disclosure.

As shown in FIG. 2, the first image may include 10 patterns (A1-A10), each pattern may have a different concentration, and 10 patterns may be arranged evenly and sequentially and correspond to one page. That is, only 10 patterns of one color correspond to one page. Therefore, the spacing between adjacent patterns may be relatively large, and accordingly, the allowable switching time between adjacent voltages may also be relatively large, which makes the voltage control less difficult, the pattern height relatively large, and makes the concentration signal value of the pattern detected by the sensor more stable.

In an optional implementation manner, the first image and the second image may correspond to a same page. For example, the first region and the second region may respectively correspond to the upper half and the lower half of the same page.

In an optional implementation manner, the first image forming module, the third image forming module, the second image forming module, and the fourth image forming module may be arranged sequentially; the first image forming module and the second image forming module may be spaced from each other; and the third image forming module and the fourth image forming module may be spaced from each other. That is, the third image forming module may be located between the first image forming module and the second image forming module; and the second image forming module may be located between the third image forming module and the fourth image forming module.

The first region may correspond to the upper half of the first page, and the second region may correspond to the lower half of the first page; that is, each of the length of the first region and the length of the second region may correspond to one half length of one page. The first image forming module may form the first image in the first region, the first image may include at most 6 first patterns arranged evenly and sequentially, the second image forming module may form the second image in the second region, the second image may include at most 6 second patterns arranged evenly and sequentially, and the sum of the height of the pattern and the spacing between adjacent patterns may be greater than or equal to 22 mm.

For example, the controller may respectively control the first image forming module to form the first image in the first region corresponding to the upper half of the first page and control the second image forming module to form the second image in the second region corresponding to the lower half of the first page. The first image and the second image may respectively include a plurality of patterns with different concentrations. The first image and the second image may respectively correspond to the upper half and the lower half of one page and may not be overlapped with each other.

Figure 3A:
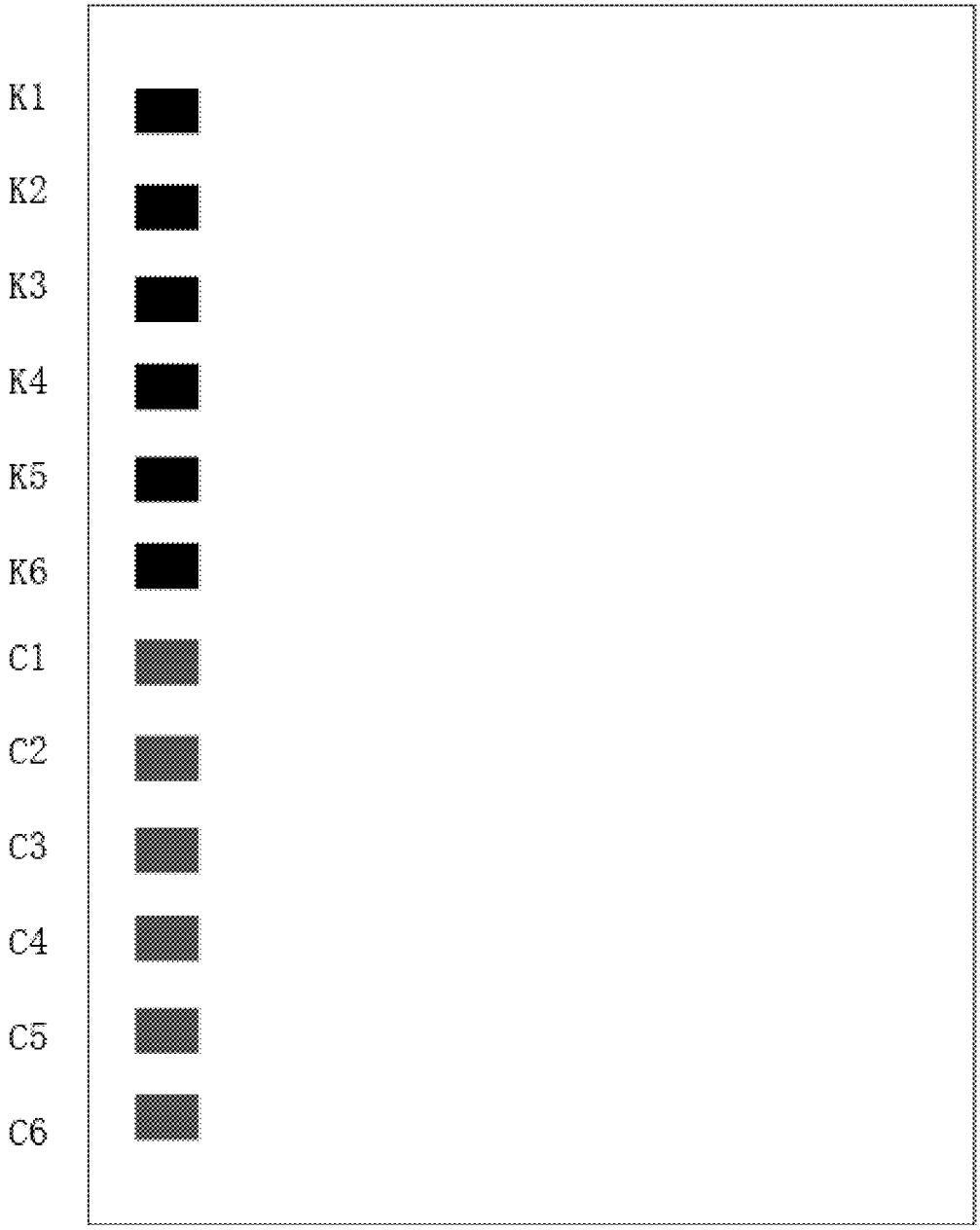
FIG. 3A illustrates a schematic of K color and C color images formed on a corresponding first page by an image forming method according to various embodiments of the present disclosure.

As shown in FIG. 3A, the first image may be a K color image, and the first image may include 6 patterns (K1-K6); and the second image may be a C color image, and the second image may include 6 patterns (C1-C6). It can be seen that the first image and the second image may respectively correspond to the upper half and the lower half of one page. Therefore, the spacing between adjacent patterns of the first image (or the second image) may be approximately 22 mm.

The third region may correspond to the upper half of the second page, and the fourth region may correspond to the lower half of the fourth page. That is, each of the length of the third region and length of the fourth region may correspond to one half length of one page. The third image forming module may form the third image in the third region, and the third image may include at most 6 third patterns arranged evenly and sequentially; and the fourth image forming module may form the fourth image in the fourth region, and the fourth image may include at most 6 fourth patterns arranged evenly and sequentially. The sum of the height of the pattern and the spacing between adjacent patterns may be greater than or equal to 22 mm.

Correspondingly, the controller may respectively control the third image forming module to form the third image in the third region corresponding to the upper half of the second page and control the fourth image forming module to form the fourth image in the fourth region corresponding to the lower half of the second page. The third image and the fourth image may respectively include a plurality of patterns with different concentrations. The third image and the fourth image may respectively correspond to the upper half and the lower half of one page and may not be overlapped with each other.

Figure 3B:
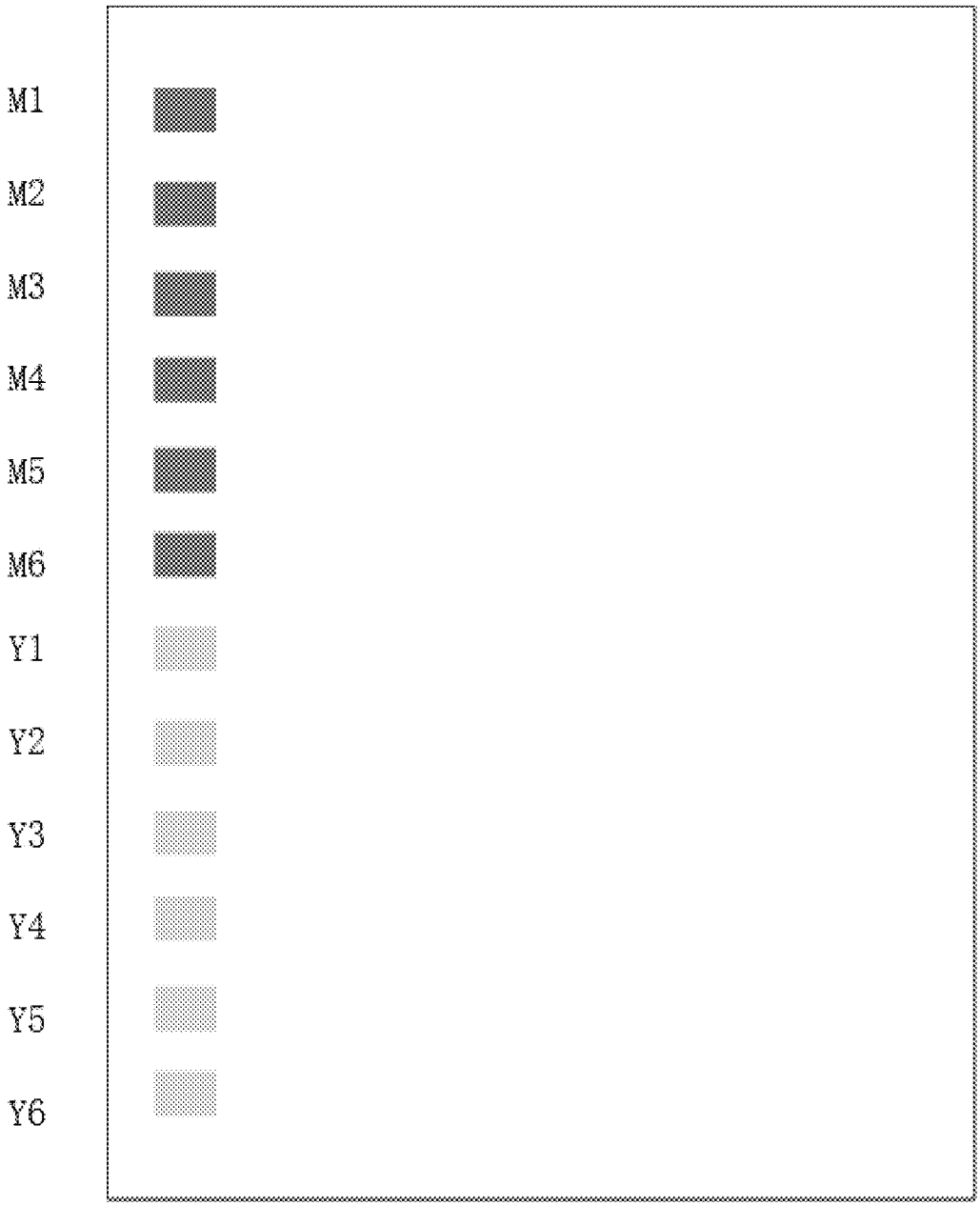
FIG. 3B illustrates a schematic of M color and Y color images formed on a corresponding second page by an image forming method according to various embodiments of the present disclosure.

As shown in FIG. 3B, the third image may be an M color image, and the third image may include 6 patterns (M1-M6); and the fourth image may be a Y color image, and the fourth image may include 6 patterns (Y1-Y6). It can be seen that the third image and the fourth image may respectively correspond to the upper half and the lower half of one page. Therefore, the spacing between adjacent patterns of the third image (or the fourth image) may be approximately 22 mm.

For example, an exemplary implementation manner of the image forming module forming the image on the image carrier may be the following.

The image forming module may generate the image according to the control signal of the controller and the image data of the image processor and may include a photosensitive drum (organic photoconductor drum (OPC)), a charging roller, an exposure device, and a developing roller.

The photosensitive drum may have a cylindrical shape, and may, together with the exposure device, convert image data as electric signals into an electrostatic latent image, which may be described hereinafter.

Through an external applied voltage, the outer peripheral surface of the photosensitive drum may be charged with positive charges (+) or negative charges (−). In other words, due to the external applied voltage, the outer peripheral surface of the photosensitive drum may have electrical polarity. When light is irradiated to the outer peripheral surface of the photosensitive drum charged in such manner, the outer peripheral surface of the photosensitive drum may discharge. In other words, when light is irradiated to the charged peripheral surface of the photosensitive drum, the peripheral surface of the photosensitive drum may lose electrical polarity.

The charging roller may apply a voltage to the outer peripheral surface of the photosensitive drum, such that the outer peripheral surface of the photosensitive drum may be charged while the photosensitive drum is rotating. For example, the charging roller may apply a certain voltage to the outer peripheral surface of the photosensitive drum through a first power source. As a result, the outer peripheral surface of the photosensitive drum may be charged with negative charges (−), and its potential may decrease. For example, when a voltage is applied to the outer peripheral surface of the photosensitive drum, the outer peripheral surface of the photosensitive drum may have a corresponding electric potential. The exposure device may receive a page synchronization signal for generating the image from the controller and receive image data representing the image from the image processor and may emit light to the outer peripheral surface of the photosensitive drum charged with the charging roller.

For example, when the exposure device receives the page synchronization signal (the control signal for generating the image) from the controller, the exposure device may emit light to the outer peripheral surface of the photosensitive drum according to image data (image data representing the image) received from the image processor. For example, the exposure device may irradiate light to a portion where the image is generated from image data and may not irradiate light to a portion where the image is not generated.

As described above, the portion of charged peripheral surface of the photosensitive drum irradiated with light may lose negative charges (−). In addition, due to the loss of negative charges (−), the potential of the portion irradiated with light may increase. As a result, a latent image (i.e., an electrostatic latent image) formed by electrostatic charges may be formed on the outer peripheral surface of the photosensitive drum. The electrostatic latent image may be formed on the outer peripheral surface of the photosensitive drum by negative charges (−) and may not be visually recognized.

Furthermore, the exposure device may include a laser scanner (LSU) or an LED print head (LPH). Herein, the laser scanner may include a light source emitting light and a mirror rotated by a motor to reflect the light emitted from the light source using the rotating mirror, thereby scanning the light to the photosensitive drum. In addition, the LED print head may include an LED array to directly irradiate light to the photosensitive drum.

The developing roller may develop the electrostatic latent image formed on the outer peripheral surface of the photosensitive drum using toner. In detail, the developing roller may charge the toner and supply the charged toner to the outer peripheral surface of the photosensitive drum. For example, a preset voltage may be applied to the developing roller through a second power source. In addition, when the voltage is applied to the developing roller, the toner may be charged by negative charges (−); and the electrostatic latent image formed on the outer peripheral surface of the photosensitive drum may be developed by charged toner. In other words, due to electrostatic attraction, the toner may adhere to the exposed portion of the outer peripheral surface of the photosensitive drum, and the toner may not adhere to the unexposed portion. As a result, a toner image corresponding to the electrostatic latent image may be generated on the outer peripheral surface of the photosensitive drum. As described above, the image generating module may generate the toner image on the outer peripheral surface of the photosensitive drum according to the page synchronization signal of the controller and the image data of the image processor.

The image carrier may include a transfer roller that can transfer the toner image formed on the outer peripheral surface of the photosensitive drum to the image carrier by electrostatic attraction. For example, a certain voltage may be applied to the transfer roller through a third power source. In addition, according to the contact between the image carrier and the transfer roller, a certain voltage may be applied to the portion of the image carrier that is in contact with the transfer roller. As a result, the toner image formed on the outer peripheral surface of the photosensitive drum may be transferred to the image carrier.

It should be understood that, through the above-mentioned exemplary embodiments, the first image forming module, the second image forming module, the third image forming module, and the fourth image forming module may respectively form images of corresponding colors on corresponding regions of the image carrier.

It should be noted that the first image forming module, the second image forming module, the third image forming module, and the fourth image forming module can be connected to a same power source; the controller may control the power source to input different voltages to the first image forming module, the second image forming module, the third image forming module, and the fourth image forming module, respectively. Optionally, the image forming apparatus may include the first power source, the second power source, the third power source, and a fourth power source. The controller may respectively control the first power supply to provide different voltages to the first image forming module, control the second power supply to provide different voltages to the second image forming module, control the third power source to provide different voltages to the third image forming module, and control the fourth power source to provide different voltages to the fourth image forming module. It should be understood that the controller can control magnitudes of outputted voltages of the power supply, the time of outputting voltages, the time of switching voltages, and the like.

It should be noted that, when the image forming apparatus performs image concentration correction, the image formed by the image forming module on the image carrier may not need to be formed on the image forming medium.

In a second aspect of the present disclosure, the present disclosure provides an image forming apparatus.

The image forming apparatus may include an image carrier which rotates along a preset direction, where the image carrier includes at least a first region and a second region each with preset lengths; a first image forming module configured to form a first image on the image carrier; a second image forming module configured to form a second image on the image carrier, where a first preset distance may be between the first image forming module and the second image forming module; and a voltage applying unit configured to simultaneously input voltages to the first image forming module and the second image forming module.

The first image forming module may form the first image on the first region of the image carrier based on the voltages, and the second image forming module may form the second image on the second region of the image carrier based on the voltages. The first image and the second image may respectively include a plurality of patterns with different concentrations; the quantity of patterns in the first image and the second image may be determined based on the first preset distance; the concentrations of the patterns may correspond to magnitudes of the voltages; and the allowable switching time between two adjacent voltages may be determined by the spacing between two adjacent patterns corresponding to the adjacent voltages.

In an optional implementation manner, the first image may include at least 6 patterns sequentially arranged on the first region.

In an optional implementation manner, the image forming apparatus may further include a third image forming module configured to form a third image on the image carrier; a fourth image forming module, configured to form a fourth image on the image carrier, where a second preset distance may be between the third image forming module and the fourth image forming module; an image carrier further including a third region and a fourth region each with preset lengths; and a voltage applying unit configured to simultaneously input voltages to the third image forming module and the fourth image forming module.

The first image forming module, the third image forming module, the second image forming module, and the fourth image forming module may be arranged sequentially.

The third image forming module may form the third image on the third region of the image carrier based on the voltages, and the fourth image forming module may form the fourth image on the fourth region of the image carrier based on the voltages. The third image and the fourth image may respectively include a plurality of patterns of different concentrations, and the quantity of patterns in the third image and the fourth image may be determined based on the second preset distance.

It should be understood that the voltage applying unit may include the first power source and the second power source; the first power source may be configured to simultaneously input voltages to the first image forming module and the second image forming module; and the second power source may be configured to simultaneously input voltages to the third image forming module and the fourth image forming module. Optionally, the voltage applying unit may include a power source, the voltage applying unit may simultaneously input voltages to the first image forming module and the second image forming module at the first moment and may simultaneously input voltages to the third image forming module and the fourth image forming module at the second moment.

In an optional implementation manner, the first image and the second image may correspond to a same page; and the third image and the fourth image may correspond to a same page.

In an optional implementation manner, the first image, the second image, the third image, and the fourth image may respectively correspond to different pages.

In an optional implementation manner, the heights of the patterns in the first image and the second image may be determined based on the first preset distance and the quantity of patterns.

It can be understood that some or all of the steps or operations in the above-mentioned embodiments may be exemplary, and other operations or various operation modifications may also be performed in the embodiments of the present disclosure. Furthermore, all steps may be performed in a different order presented in the above-mentioned embodiments, and it may not be necessary to perform all operations in the above-mentioned embodiments.

Figure 4:
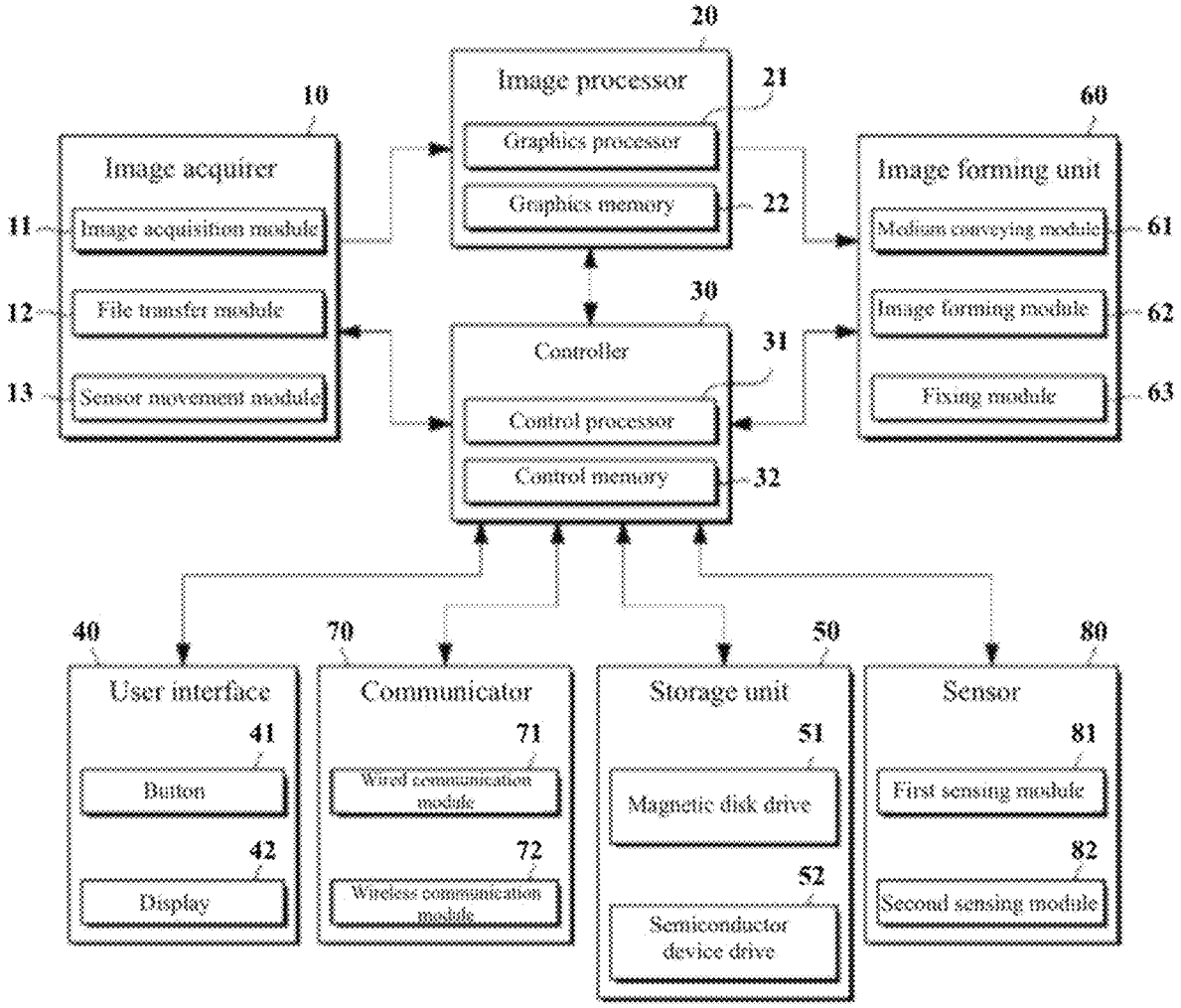
FIG. 4 illustrates a structural diagram of an exemplary image forming apparatus according to various embodiments of the present disclosure.

FIG. 4 illustrates a structural diagram of an exemplary image forming apparatus according to various embodiments of the present disclosure. As shown in FIG. 4, the above-mentioned image forming apparatus 60 may include an image acquirer 10, an image processor 20, a controller 30, a user interface 40, a storage unit 50, an image forming unit 60, a communicator 70, and a sensor 80.

The image acquirer 10 may acquire the image formed on the surface of the image carrier or the image forming medium and output image data corresponding to the acquired image. The image acquirer 10 may include an image acquisition module 11, configured to acquire the image formed on the surface of the image carrier or the image forming medium; a file transfer module 12, configured to transfer a file D; and a sensor movement module 13. The image acquisition module 11 may include a plurality of light-emitting elements (e.g., photodiodes and the like) arranged in a series and a plurality of photoelectric detection elements (e.g., photosensors and the like) arranged in a series. Since the plurality of photoelectric detection elements arranged in a series as described above can be used to acquire one-dimensional images, the photoelectric detection elements may generally be referred to as "linear image sensors".

The user interface 40 may interact with the user. For example, the user interface 40 may receive input from the user, such as a color/monochrome configuration (the image forming apparatus acquires a color image or a monochrome image formed in the image carrier or image forming medium according to the configuration), resolution configuration (configured to obtain the image formed on the image carrier or image forming medium), and the like. The user interface 40 may include a plurality of buttons 41 which receives preset user inputs from the user via the buttons, and a display 42 which displays various types of information.

The storage unit 50 may store control programs and control data for controlling the image forming apparatus, and various application programs and application data, according to various functions inputted by the user, which are executed by the image forming apparatus. For example, the storage unit 50 may store an operating system (OS) program for managing elements and resources (software and hardware) contained in the image forming apparatus, an image reproduction program for displaying file images, and the like. Particularly, the storage unit 50 may store the test pattern for image concentration correction (hue recursive control (TRC)) or the test pattern for automatic color registration (ACR). The storage unit 50 may include a non-volatile memory where programs or data in the non-volatile memory may not be lost even if the power is turned off. For example, the storage unit 50 may include a magnetic disk drive (hard disk drive) 51, or a semiconductor device drive (solid state drive) 52, or the like.

The communicator 70 may transmit data to or receive data from an external device. For example, the communicator 70 may receive image data from the user's desktop terminal or receive image data from the user's portable terminal. The communicator 70 may include a wired communication module 71 which transmits data to or receives data from an external device in a wired manner via a wire, and a wireless communication module 72 which wirelessly transmits data to or receives data from an external device via radio waves. The wired communication module 71 may be an Ethernet™ module, a token ring module, a universal serial bus (USB) communication module, a digital subscriber line (DSL) module, a point-to-point protocol (PPP) module, or the like. The wireless communication module 72 may be a Wi-Fi™ module, a Bluetooth™ module, a ZigBee module, a near field communication (NFC) module, or the like.

The image forming unit 60 may form the image on the printing medium according to image data. For example, the image forming unit 60 may collect the printing medium accommodated in a paper supply tray, form the image on the collected printing medium, and discharge the printing medium with the formed image to a discharge tray. The image forming unit 60 may include a medium conveying module 61, an image forming module 62, and a fixing module 63.

The image forming module 62 may include the first image forming module, the second image forming module, the third image forming module, and the fourth image forming module.

The sensor 80 may acquire information related to the toner image generated using the image forming module 62. For example, the sensor 80 may sense the toner concentration for forming the toner image or may sense the pattern of the toner image. The sensor 80 may include a first sensing module 81 which senses the toner concentration for forming the toner image and outputs an electrical signal corresponding to the concentration of the toner image; and include a second sensing module 82 which senses the pattern of the toner image and outputs an electrical signal corresponding to the sensed pattern.

The image processor 20 may analyze and process the image acquired by the image acquirer 10 or the image received through the communicator 70. In addition, the image processor 20 may transmit the image to be formed on the printing medium to the image forming unit 60.

The image processor 20 may include a graphics processor 21 which is configured to execute calculations for processing images and a graphics memory 22 which stores programs or data related to the calculations performed by the graphics processor 21. The graphics processor 21 may include an arithmetic and logic unit (ALU) configured for executing calculations of image processing and a storage circuit configured for storing data to be used in calculations or calculated data. The graphics memory 22 may be one of volatile memories, such as a static random access memory (SRAM), a dynamic random access memory (DRAM), and the like, and non-volatile memories, such as a read-only memory, an erasable programmable read-only memory (EPROM), an electrically erasable programmable read-only memory (EEPROM), a flash memory, and the like.

The controller 30 may control the operations of the image acquirer 10, the user interface 40, the storage unit 50, the image forming unit 60, the communicator 70, the sensor 80, and the image processor 20 described above. For example, the controller 30 may control the image processor 20, such that the image processor 20 may transmit one-dimensional images to the image forming unit 60, and control the image forming unit 60, such that the image forming unit 60 may generate toner images based on the one-dimensional image transmitted by the image processor 20. In addition, the controller 30 may control the sensor 80 to sense the toner concentration of the toner image generated using the image forming unit 60 or control the sensor 80 to detect the pattern of the toner image generated using the image forming unit 60. The controller 30 may include a control processor 31 configured to perform calculations for controlling the operation of the image forming apparatus; and include a control memory 32 configured to store programs and data related to calculation operations performed by the control processor 31. The control processor 31 may include an arithmetic and logic unit (ALU) that is configured to execute calculation operations of the image forming apparatus and include a storage circuit for storing data to be used in calculations or calculated data. The control memory 32 may be one of volatile memories such as SRAM, DRAM, and the like, and non-volatile memories such as a read-only memory, EPROM, EEPROM, a flash memory, and the like.

For example, the image forming apparatus may include one or more integrated circuits configured to implement the above-mentioned method. For example, one or more integrated circuits may include one or more application specific integrated circuits (hereinafter referred to as ASIC), or one or more microprocessor (digital signal processor which is hereinafter referred to as DSP), or one or more field programmable gate array (hereinafter referred to as FPGA), and the like. For another example, these modules may be integrated together to be implemented in the form of a system-on-a-chip (hereinafter referred to as SOC).

The controller 30, the communicator 70, and the storage unit 50 may communicate with each other through internal connection paths to transfer control and/or data signals. The storage unit 50 may be configured to store computer programs, and the controller 30 may be configured to invoke and run the computer programs from the storage unit 50.

The above-mentioned storage unit 50 may be a read-only memory (ROM), other types of static storage devices which can store static information and instructions, a random access memory (RAM) or other types of dynamic storage devices which can store information and instruction; may also be an electrically erasable programmable read-only memory (EEPROM), a compact disc read-only memory (CD-ROM), other optical disc storage, optical disc storage (including a compact disc, a laser disc, an optical disc, a digital versatile disc, a Blu-ray disc, and the like), a disk storage media or other magnetic storage devices; or may also be any other media which can be used to carry or store desired program codes in the form of instructions or data structures and can be accessed by a computer.

In the above-mentioned embodiments, the related processors may include, for example, a CPU, a DSP, a microcontroller or a digital signal processor; and may also include a GPU, an embedded neural network processor (neural-network process unit which is hereinafter referred to as NPU), and an image signal processor (image signal processing which is hereinafter referred to as ISP). The processors may also include necessary hardware accelerators or logic processing hardware circuits, such as ASICs, or include one or more integrated circuits configured to control the implementation of the technical solutions of the disclosure. Furthermore, the processors may have functions of operating one or more software programs, and the software programs may be stored in a storage medium.

Various embodiments of the present disclosure also provide a computer-readable storage medium that stores computer programs. When running on a computer, the computer programs may make the computer execute the method provided in various embodiments of the present disclosure.

Various embodiments of the present disclosure also provide a computer program product. The computer program product includes computer programs. When running on a computer, computer programs may make the computer execute the method provided in various embodiments of the present disclosure.

In various embodiments of the present disclosure, "at least one" may refer to one or more, and "multiple" may refer to two or more. "And/or" may describe the association relationship of associated objects, indicating that there can be three types of relationships. For example, A and/or B may indicate A alone, both A and B, and B alone. A and B may be singular or plural. The character "/" generally may indicate that associated objects before and after are in an "or" relationship. "At least one item of the following" and similar expressions may refer to any combination of these items, including any combination of single items or plural items. For example, at least one of a, b, and c may indicate a, b, c, a and b, a and c, b and c, or a and b and c, where a, b, and c may be single or multiple.

Those skilled in the art should understand that units and algorithm steps described in various embodiments of the present disclosure may be implemented by a combination of electronic hardware, computer software, and electronic hardware. Whether these functions are executed by hardware or software depends on specific applications and design constraint conditions of the technical solutions. Those skilled in the art may use different methods for each specific application to implement the described functions, but such implementation should not be considered beyond the scope of the present disclosure.

Those skilled in the art may clearly understand that, for the convenience and conciseness of description, the specific working process of the system, device and unit described above may refer to the corresponding process in the above-mentioned method embodiment, which may not be described in detail herein.

In some embodiments provided in the present disclosure, if any function is implemented in the form of a software functional unit and sold or used as an independent product, it may be stored in a computer readable storage medium. Based on such understanding, an essential part of the technical solutions of the present disclosure, or a part which contributes to the existing technology, or a part of the technical solution may be embodied in the form of a software product. The computer software product may be stored in a storage medium and include a plurality of instructions to make a computer device (e.g., a personal computer, a server, or a network device, or the like) execute all or part of the steps of the methods described in the various embodiments of the present disclosure. The above-mentioned storage media may include various media which can store program codes, such as a U disk, a mobile hard disk, a read-only memory (hereinafter referred to as ROM), and a random access memory (hereinafter referred to as RAM), a magnetic disk, an optical disk, and/or the like.

The above may merely be particular implementation manners of the present disclosure. Those skilled in the art may easily think of changes or substitutions within the technical scope disclosed in the present disclosure, and those changes or substitutions should be covered by the protection scope of the present disclosure. The protection scope of the present disclosure shall be subject to the protection scope of the claims.

What is claimed is:

1. An image forming method, applied to an image forming apparatus, the method comprising:

applying voltages to form, in an order of position on an image carrier, a first image, a third image, a second image, and a fourth image, wherein the order of position reflects a toner black in the first image, a toner magenta in the third image, a toner cyan in the second image, and a toner yellow in the fourth image, and wherein the first image includes a first pattern of the first image and a second pattern of the first image, and the second image includes a first pattern of the second image and a second pattern of the second image, and wherein applying voltages includes:

simultaneously applying a first voltage to form the first pattern of the first image and the first pattern of the second image; and simultaneously applying a second voltage to form the second pattern of the first image and the second pattern of the second image, the second voltage being different than the first voltage.

2. The method according to claim 1, wherein one or more of the first image, the third image, the second image, and the fourth image occupy a half page of a page.

3. The method according to claim 1, wherein the first image, the second image, the third image, or the fourth image includes at most six patterns of a same color.

4. An image forming apparatus, comprising: an image forming module; an image carrier; a voltage applying unit; a memory; and a processor coupled to the memory and configured to perform:

applying voltages to form, in an order of position on an image carrier, a first image, a third image, a second image, and a fourth image, wherein the order of position reflects a toner black in the first image, a toner magenta in the third image, a toner cyan in the second image, and a toner yellow in the fourth image, and wherein the first image includes a first pattern of the first image and a second pattern of the first image, and the second image includes a first pattern of the second image and a second pattern of the second image, and wherein applying voltages includes:

simultaneously applying a first voltage to form the first pattern of the first image and the first pattern of the second image; and simultaneously applying a second voltage to form the second pattern of the first image and the second pattern of the second image, the second voltage being different than the first voltage.

5. The apparatus according to claim 4, wherein one or more of the first image, the third image, the second image, and the fourth image occupy a half page of a page.

6. A non-transitory computer-readable storage medium, containing program instructions for, when being executed by a processor, performing an image forming method, the image forming method comprising:

applying voltages to form, in an order of position on an image carrier, a first image, a third image, a second image, and a fourth image, wherein the order of position reflects a toner black in the first image, a toner magenta in the third image, a toner cyan in the second image, and a toner yellow in the fourth image, and wherein the first image includes a first pattern of the first image and a second pattern of the first image, and the second image includes a first pattern of the second image and a second pattern of the second image, and wherein applying voltages includes:

simultaneously applying a first voltage to form the first pattern of the first image and the first pattern of the second image; and simultaneously applying a second voltage to form the second pattern of the first image and the second pattern of the second image, the second voltage being different than the first voltage.

7. The storage medium according to claim 6, wherein one or more of the first image, the third image, the second image, and the fourth image occupy a half page of a page.

* * * * *